US006918759B2

(12) United States Patent
Cho et al.

(10) Patent No.: US 6,918,759 B2
(45) Date of Patent: Jul. 19, 2005

(54) PREMIXED COMBUSTION GAS BURNER HAVING SEPARATED FIRE HOLE UNITS

(75) Inventors: Seung Beom Cho, Pyungtaek-shi (KR); Hee Suk Sun, Seongnam-shi (KR)

(73) Assignee: Kyungdong Boiler Co., Ltd., Gyonggi-do (KR)

( * ) Notice: Subject to any disclaimer, the term of this patent is extended or adjusted under 35 U.S.C. 154(b) by 0 days.

(21) Appl. No.: 10/690,432

(22) Filed: Oct. 21, 2003

(65) Prior Publication Data

US 2004/0121277 A1 Jun. 24, 2004

(30) Foreign Application Priority Data

Oct. 22, 2002 (KR) ..... 10-2002-64497
Oct. 22, 2002 (KR) ..... 10-2002-64496

(51) Int. Cl.[7] ..... F23D 14/62; F23D 14/08
(52) U.S. Cl. ..... 431/354; 431/278; 431/154
(58) Field of Search ..... 431/326, 328, 431/354, 285, 346, 349, 278, 154; 126/92 R, 92 AC, 92 C, 85 R, 91 R

(56) References Cited

U.S. PATENT DOCUMENTS 1,830,464 A * 11/1931 Guenther ..... 431/285
3,799,452 A * 3/1974 Hein ..... 239/553.3
4,674,973 A * 6/1987 Wright ..... 431/284
5,525,054 A * 6/1996 Nakaura et al. ..... 431/285
5,833,449 A * 11/1998 Knight et al. ..... 431/191
6,746,236 B2 * 6/2004 Kuriyama et al. ..... 431/354

FOREIGN PATENT DOCUMENTS

JP 4-186004 A * 7/1992 ..... F23D/14/08
JP 2001-241617 A * 9/2001 ..... F23D/14/08

* cited by examiner

*Primary Examiner*—Josiah C. Cocks
(74) *Attorney, Agent, or Firm*—Devine, Millimet & Branch; Paul C. Remus; Michelle Saquet Temple

(57) ABSTRACT

A premixed combustion gas burner having separated fire hole units including a tube-shaped burner whose front face is opened and inner portion is of a hollow tubular shape so that the whole fire hole units of the burner can be separated to thus prevent deformation due to thermal expansion, in which fire hole units each having a number of fire holes formed at a predetermined distance from one another are disposed in both edge lines and the inner portion on the upper end face, and loaders each having a predetermined space are formed between the fire hole units; and a plate-shaped burner which is made of a plate-shaped material having a pin structure formed on the bottom thereof so as to be mounted on the loaders formed in the tube-shaped burner, in which fire hole units having a number of fire holes formed at a predetermined distance are disposed in the form of a slit along both the edge lines of the upper end face. Here, the number of fire holes forming the fire hole units of the tube-shaped burner and the plate-shaped burner are formed with a uniform size by a press, and a cooling water tube is disposed to penetrate the fire holes through fitting holes formed on the lateral surface of the tube-shaped burner and fitting holes formed on the pin-structure formed on the bottom of the plate-shaped burner, in correspondence to the fitting holes of the tube-shaped burner.

3 Claims, 4 Drawing Sheets

PREMIXED COMBUSTION GAS BURNER HAVING SEPARATED FIRE HOLE UNITS

BACKGROUND OF THE INVENTION

1. Field of the Invention

The present invention relates to a premixed combustion gas burner having separated fire hole units, and more particularly, to a premixed combustion gas burner having separated fire hole units in which a total number of fire hole units formed on the surface of the burner are separated into several pieces in the premixed combustion gas burner having a tube-shaped burner and a plate-shaped burner which are separated from each other, and a cooling water tube penetrates a pin structure formed on the lower end of the plate-shaped burner, to thereby easily change the size and number of the fire hole units to easily change a total capacity of the burner, prevent deformation of the burner such as buckling due to thermal tension existing in the burner which may be caused by an excessive running of the burner and thermal expansion deformation, and play a role of making the water tube fixing the tube-shaped burner and the plate-shaped burner.

2. Description of the Related Art

As is well-known, a boiler for heating and supplying hot water for use in a general home, is divided into an oil boiler and a gas boiler, according to a fuel used. The oil boiler or the gas boiler uses a burner for burning oil or gas which is used in the boiler.

Thus, a general burner obtains heat by burning fuel safely and efficiently. According to the kind of fuel used, the burner is classified as either a gas burner for combustion of gas, an oil burner for combustion of liquid fuel such as kerosene or diesel oil, or a powdered coal burner for combustion of coal.

Additionally, the burner is divided into a premixed combustion burner and a diffusion combustion burner according to a method for mixing fuel and air. The premixed combustion burner burns fuel and air which have been mixed in advance. The diffusion combustion burner burns mixed fuel and air, the fuel and air are separately supplied to a burner and mixed therein.

However, the Bunsen gas burner has a long flame and a high flame temperature, thus needs more that an theoretical amount of air. Accordingly, there is an increase loss of heat due to high-temperature exhaust gas. This leads to an increased amount of pollutants such as $NO_x$ and CO. As a result, the Bunsen gas burner is somewhat limited in accomplishing maximum efficiency and reduction of pollutants in the gas burner equipment.

Also, a premixed combustion gas burner using knitted metal fiber mat of porous metal fiber weaving tissue which is used as a surface material of a combustion gas burner is used to reduce polluted materials such as $NO_x$ and CO and flame temperature. The knitted metal fiber mat of porous metal fiber weaving tissue which is used as a surface material of a combustion gas burner is woven like a fiber tissue with a metallic material of 50 $\mu$m or less in diameter. This is used as the surface material of the combustion gas burner to perform perfect combustion of inflammable premixed gas on the combustion surface, and then heat the combustion surface of the gas burner formed of the knitted metal fiber mat of metal fiber weaving tissue with the combustion heat. This thereby obtains a strong and uniform solid-state radiation energy from the combustion surface of the gas burner.

A loss of heat due to exhaust gas is reduced by reducing an amount of excessive air for combustion and lowering the temperature of combustion exhaust gas. This thereby provides an increase in thermal efficiency and suppresses pollutant materials such as $NO_x$ and CO that are discharged. Also, a range of a combustion load (a turndown ratio: TDR) is considerably wider than that of the general gas burners whose TDR is 5 to 1. Also, the stability of flame is remarkably superior to the that of the general gas burner and employs a simple structure. As described above, the knitted metal fiber mat of porous metal fiber weaving tissue is widely used as a combustion surface material for a gas burner for home use, commercial use and industrial use in order to enhance thermal efficiency and lower polluted materials in gas combustion equipment.

In particular, materials such as ceramic or stainless steel, and knitted metal fiber mat of porous metal fiber weaving tissue are used as a combustion surface material for a gas burner. Since the knitted metal fiber mat of porous metal fiber weaving tissue has a thermal treatment effect which lowers the temperature of the rear surface of the burner into an ignition temperature or less, it is known as a safe material having burner flames running few risk of backfiring through small holes on the knitted metal fiber mat of porous metal fiber weaving tissue, when the knitted metal fiber mat is used as the combustion surface material of the gas burner in order to perform combustion of the premixed gas. Thus, the gas burner using knitted metal fiber mat of porous metal fiber weaving tissue has an advantage of having no need to specially countermeasure a backfire phenomenon, which is used to reduce polluted materials such as $NO_x$ and CO and lower the temperature of flames.

However, in the case where the temperature of flames is low in the conventional premixed combustion gas burner, the burner flames may be unstable. This may raise the production cost and may make fabrication difficult. Also, it be difficult to stably control combustion of the premixed gas in home gas burner equipment which has a simple structure.

Also, in the case that ceramic, stainless steel, or knitted metal fiber mat of porous metal fiber weaving tissue is used as a combustion surface material of the premixed combustion gas slits, a premixer for premixing fuel gas and air may become large and somewhat complicated. As a result, the air blowing resistance increases due to a loss of pressure in the premixer and thus either abnormal noise may occur as part of a high-load region during combustion or main flames of the gas burner may be unstable.

As described above, in the case of the conventional premixed combustion gas burner, fire hole units forming a burner are formed on a single plate-shaped material or cylindrical vessel, or knitted as metal fiber. When fire hole units are formed on a single plate-shaped material or cylindrical vessel, the burner surface may be twisted due to thermal expansion. When metal fiber is used in a gas burner, the metal fiber is pulled and then assembled during assembling. Thereby, fire hole units are formed largely locally or in whole on the metal fiber, and thus cause scattering of the flames, which may cause flames to lack uniformity and a backfire to occur. Additionally, the conventional premixed combustion gas burner is expensive and difficult to fabricate.

In particular, the conventional premixed combustion gas burner having a tubular shape has downsides. Specifically, it is difficult to prevent deformation such as buckling due to either thermal tension at the time of an excessive running of the burner, damage by a fire of the burner surface due to overheat, or excessive production of nitrogen oxide due to heal.

Also, the conventional premixed combustion gas burner has a problem that it is difficult to mount a separate device such as a cooling water tube for cooling overheat of the burner.

SUMMARY OF THE INVENTION

To solve the above problems, it is an object of the present invention to provide a premixed combustion gas burner having separated fire hole units, in which a total number of fire hole units formed on the surface of the burner are separated into several pieces, to thereby prevent deformation due to thermal expansion, and easily change the size and number of the fire hole units to easily change a total capacity of the burner.

It is another object of the present invention to provide a premixed combustion gas burner having a tube-shaped burner and a plate-shaped burner which are separated from each other, in which a cooling water tube penetrates a pin structure formed on the lower end of the plate-shaped burner, to thereby prevent deformation of the burner such as buckling due to thermal tension existing in the burner which may be caused by an excessive running of the burner, lowering the temperature of flames to reduce an amount of nitrogen oxide to be produced, preventing damage by a fire due to cumulative heat on the burner surface, and playing a role of making the water tube fixing the tube-shaped burner and the plate-shaped burner.

To accomplish the above object of the present invention, there is provided a premixed combustion gas burner having separated fire hole units comprising: a tube-shaped burner whose front face is opened and inner portion is of a hollow tubular shape so that the whole fire hole units of the burner can be separated to thus prevent deformation due to thermal expansion, in which fire hole units each having a number of fire holes formed at a predetermined distance from one another are disposed in both edge lines and the inner portion on the upper end face, and loaders each having a predetermined space are formed between the fire hole units; and a plate-shaped burner which is made of a plate-shaped material having a pin structure formed on the bottom thereof so as to be mounted on the loaders formed in the tube-shaped burner, in which fire hole units having a number of fire holes formed at a predetermined distance are disposed in the form of a slit along both the edge lines of the upper end face.

Here, the number of fire holes forming the fire hole units of the tube-shaped burner and the plate-shaped burner are formed with a uniform size by a press.

Preferably, a cooling water tube is disposed to penetrate the fire holes through fitting holes formed on the lateral surface of the tube-shaped burner and fitting holes formed on the pin-structure formed on the bottom of the plate-shaped burner, in correspondence to the fitting holes of the tube-shaped burner.

BRIEF DESCRIPTION OF THE DRAWINGS

The above and other object and advantages of the present invention will become more apparent by describing the preferred embodiment thereof in detail with reference to the accompanying drawings in which.

DETAILED DESCRIPTION OF THE INVENTION

A premixed combustion gas burner having separated fire hole units according to a preferred embodiment of the present invention will be described below with reference to the accompanying drawings.

Figure 1:
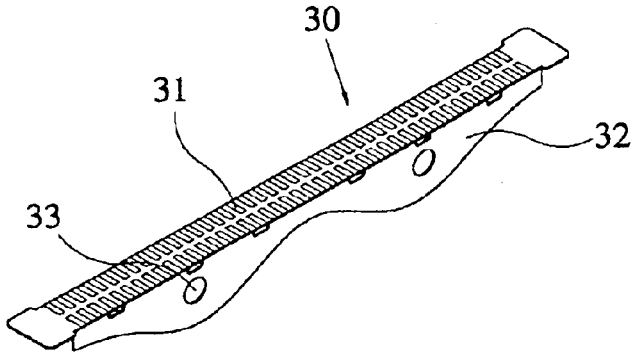
FIG. 1 is a perspective view showing a tube-shaped burner forming a premixed combustion gas burner according to the present invention.
Figure 2:
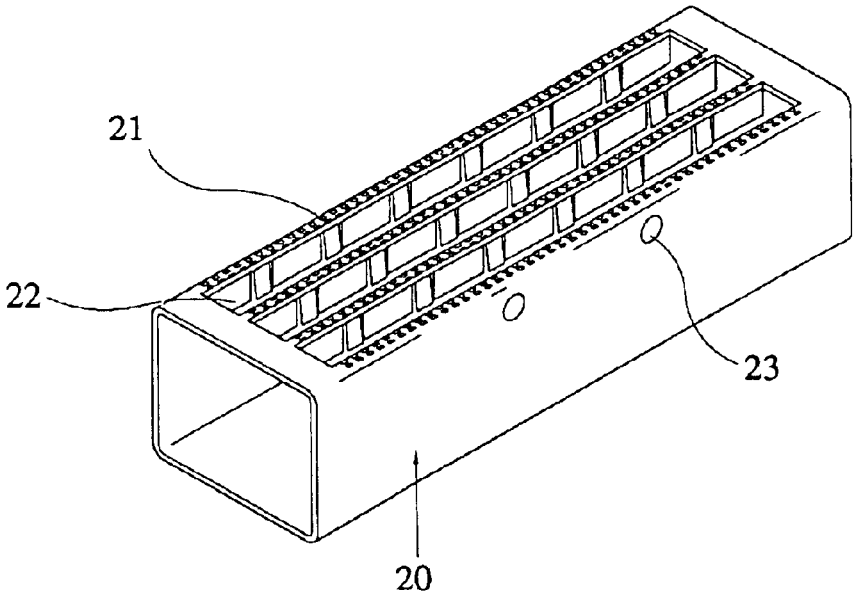
FIG. 2 is a perspective view showing a plate-shaped burner forming a premixed combustion gas burner according to the present invention.
Figure 3:
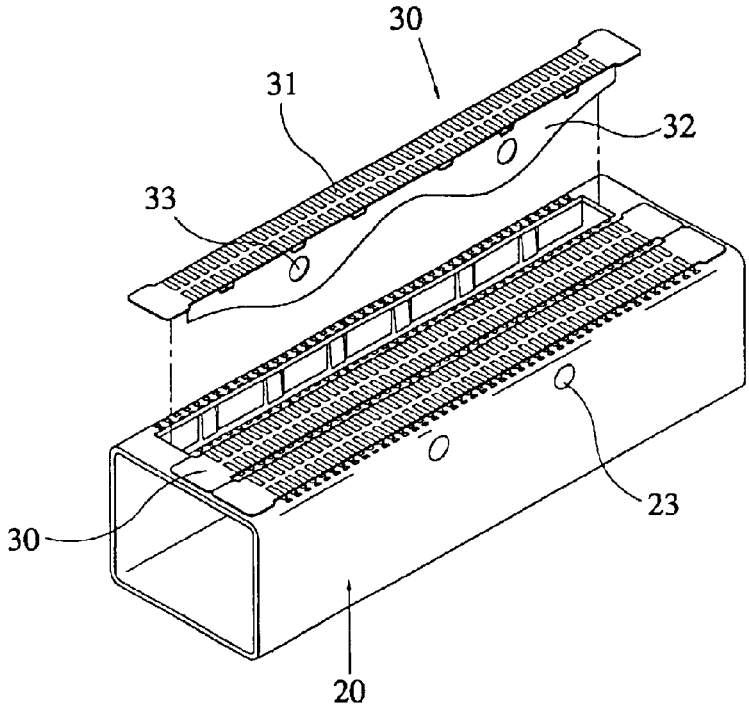
FIG. 3 is a perspective view showing an assembly state of the premixed combustion gas burner according to the present invention.

Referring to FIGS. 1 through 3, a premixed combustion gas burner having separated fire hole units includes a tube-shaped burner 20 in which fire hole units 21, each having a number of fire holes formed at a predetermined distance from one another, disposed on the upper end face. These fire holes are for burning gas and air in a mixed state. A plate-shaped burner 30 which is detachably disposed in loaders 22 is formed between the fire hole units 21 formed on the upper end of the tube-shaped burner 20. The fire hole units 31 have a number of fire holes are disposed.

As shown in FIG. 1, in the tube-shaped burner 20, according to the present invention, having a front face opened and an inner portion of a hollow tubular shape, fire hole units 21, each having a number of fire holes formed with a uniform size at a predetermined distance from one another, are disposed in both edge lines and the inner portion on the upper end face. Loaders 22 are formed between the fire hole units 21 which mount the plate-shaped burner 30 between the fire hole units 21 in turn.

It is preferable that the fire holes constituting the fire hole units 21 are formed of a circular shape or tubular shape, respectively. Also, the tube-shaped burner 20 is formed of a number of tubular burners connected in parallel with one another, in units of a single tubular shape.

Figure 4:
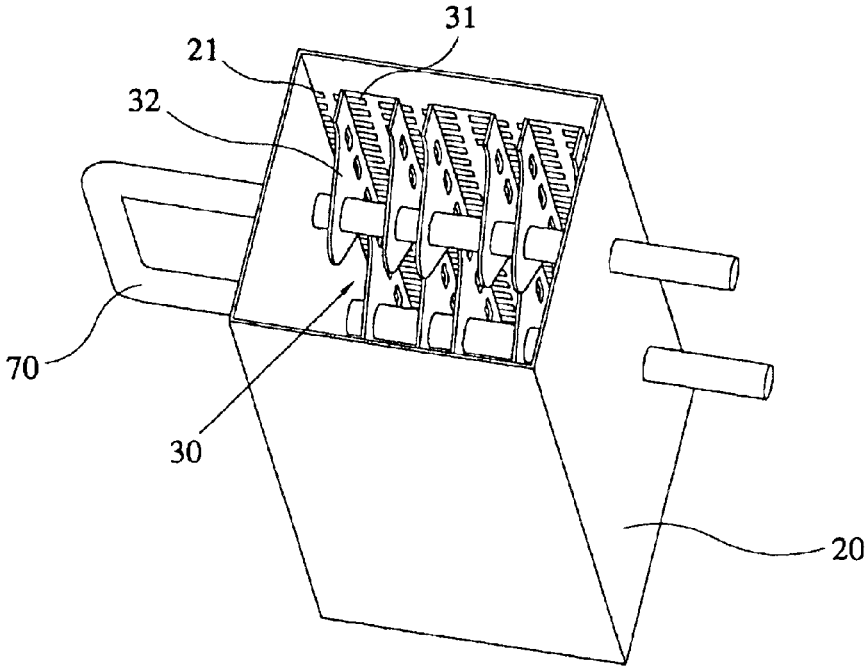
FIG. 4 is a perspective view showing an assembly state where a cooling water tube is assembled with the premixed combustion gas burner according to the present invention.
Figure 5:
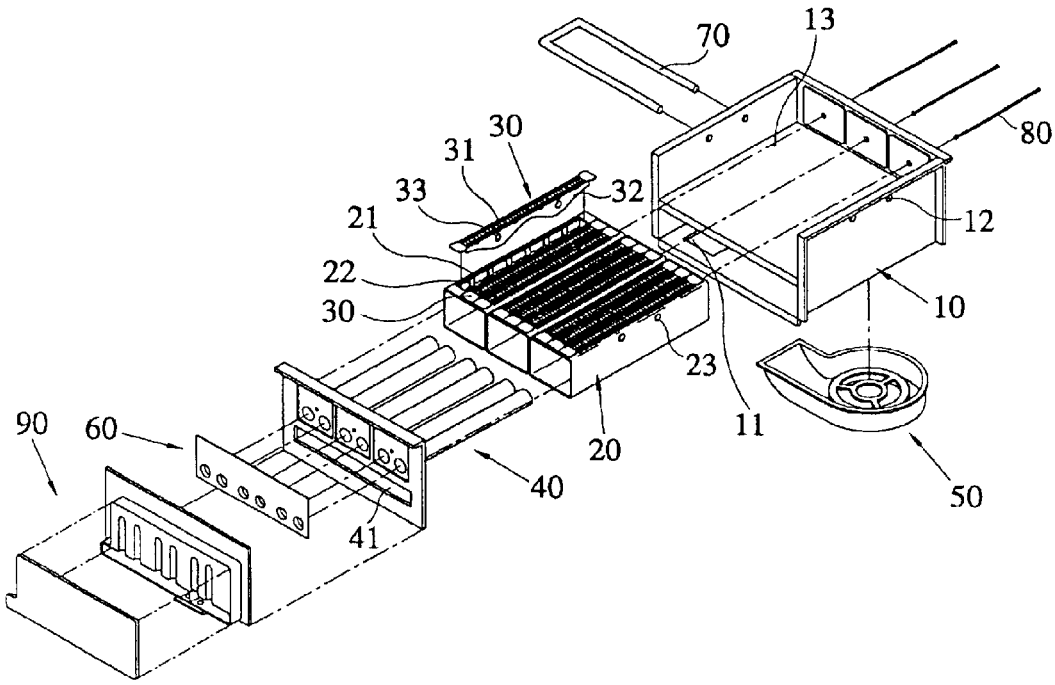
FIG. 5 is an exploded perspective view showing the whole configuration of a combustion gas burner in which the premixed combustion gas burner according to the present invention is applied.

A plurality of fitting holes 23 through which a cooling water tube 70 of FIGS. 4 and 5 is fitted and which is fixedly connected with the plate-shaped burner 30 which will be described later, are formed at a predetermined distance on the lateral surface of the tube-shaped burner 20. Also, as shown in FIG. 2, the plate-shaped burner 30 mounted on loaders 22 formed in the tube-shaped burner 20 is a burner made of a plate-shaped material on which a protruding pin structure 32 is formed having a predetermined curvature.

Thus, the plate-shaped burner 30 has a structure where fire hole units 31 are disposed along both edge lines on the upper surface of the plate-shaped material. Additionally, each fire hole unit has a number of fire holes at a predetermined distance in the form of a slit of a uniform size, like the tube-shaped burner 20.

Also, fitting holes 33 formed on the pin-structure 32 which is formed on the bottom of the plate-shaped burner 30, through which a cooling water tube 70 of FIG. 4 can penetrate, are formed in correspondence to the fitting holes 23 of the tube-shaped burner 20. In particular, fire hole units 21 and 31, each having a number of fire holes formed in the tube-shaped burner 20 and the plate-shaped burner 30, has a uniform performance in a single burner because each fire hole is uniformly formed by a press.

The tube-shaped burner 20 and the plate-shaped burner 30 having the above-described structures constitute a single premixed combustion gas burner in which the plate-shaped burner 30 is mounted on the loaders 22 of the tube-shaped burner 20. The fire hole unit 21 of the tube-shaped burner 20 is located in the middle of the plate-shaped burners 30, and the fire hole unit 21 of the tube-shaped burner 20 makes flames easily transmitted between the plate-shaped burners 30. When the tube-shaped burners 20 are connected in parallel with one another, the leftmost and rightmost fire hole units 21 play a role of easily transmitting flames between the tube-shaped burners 20.

Figure 6:
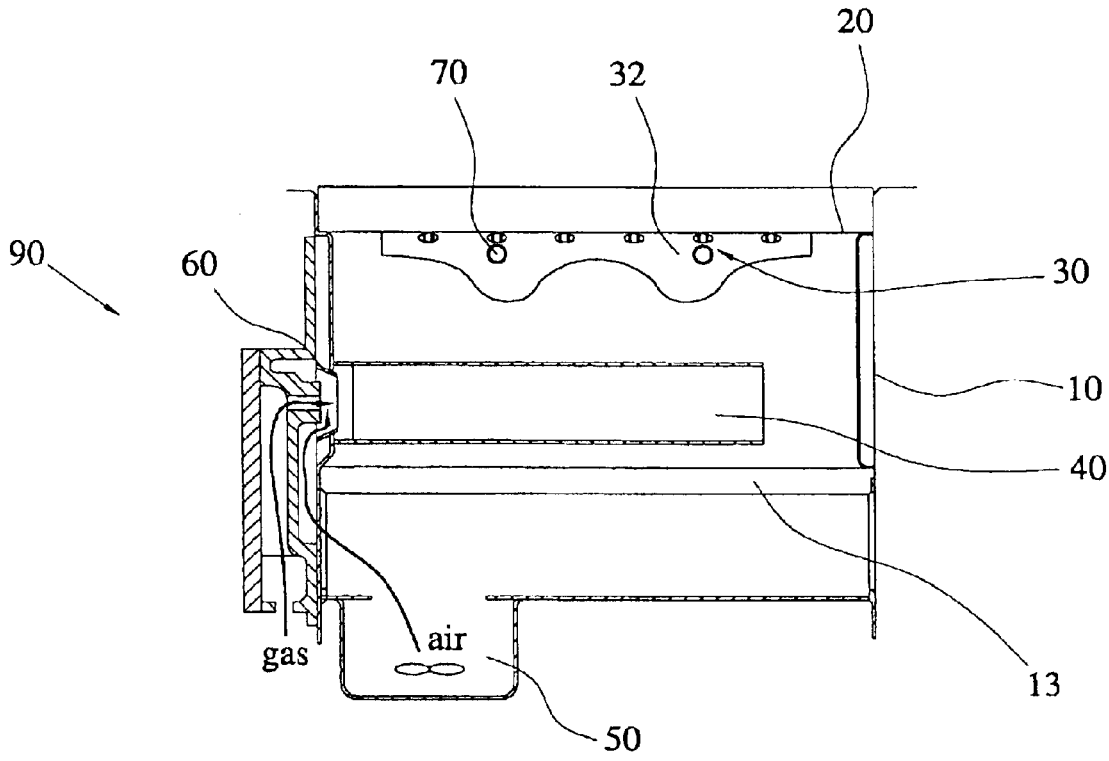
FIG. 6 is a cross-sectional view showing an assembly state of the combustion gas burner of FIG. 5 according to the present invention.

As shown in FIGS. 5 and 6, the premixed combustion gas burner according to the present invention having the above-described structure employs a structure of performing a multi-stage control of a burner. Premixed combustion gas burners, each including several tube-shaped burners 20 and several plate-shaped burners 30 whose output capacity is identical, are disposed in parallel with one another. They thereby perform a combustion operation by varying the number of burners according to a desired heat capacity.

The premixed combustion gas burner has a main casing 10 on the bottom surface of which an air blower 50 is mounted so that air can be supplied from the air blower 50 through an air inlet 11 formed on the lower portion of the premixed combustion gas burner. A partition 13, partitioning between the air blower 50 mounted on the bottom of the main casing 10 and the tube-shaped burner 20, is formed at a distance from the bottom surface of the main casing 10. Also, the tube-shaped burner 20 is loaded over the partition 13.

As described above, the premixed combustion gas burner formed of the tube-shaped burner 20 and the plate-shaped burner 30 is disposed in parallel on the partition 13 provided in the main casing 10. Additionally, a number of mixture supply tubes 40 which are inserted into the tube-shaped burner 20 and disposed at a distance from each other are provided in the front surface of the main casing 10. Gas and air can be mixed and supplied to the tube-shaped burner 20 and the plate-shaped burner 30 according to the present invention. Also, Venturi tubes 60 mix the gas and air and distribute the mixed flow amount needed for combustion of the burner. The mixed flow amount is independently supplied to each burner. The Venturi tubes 60 are installed on the front surface of the mixture supply tubes 40.

As described above, the mixture supply tubes 40 inserted and mounted into the tube-shaped burner 20 are provided in the front surface of the tube-shaped burner 20. The mixture supply tubes 40 play a role of mixing gas and air and supplying the mixture to the burner as described above. Thus, this is an advantage over the conventional premixed combustion gas burner which should include a separate mixing chamber. In the mixture supply tubes 40, gas and air are supplied through separate paths simultaneously and then mixedly supplied to the burner at the state where gas and air are mixed while passing through the mixture supply tubes 40.

As described above, the Venturi tubes 60 play the role in mixing gas and air and distributing the mixed flow amount needed for combustion of the burner. The Venturi tubes 60 are independently supplied to each burner and are installed on the front surface of the mixture supply tubes 40.

That is, since gas and air are mixed through the mixture supply tubes 40 and the Venturi tubes 60 during inflow of gas and air and the mixture is supplied to the burner in the present invention, a separate mixing chamber which is required in the conventional premixed combustion gas burner is not needed. Thus, secondary air need not be supplied to the burner in the present invention, which is a typical premixed combustion gas burner.

Also, an inlet hole 90 called a manifolder through which air and gas can be supplied is provided in front of each of the Venturi tubes 60. Accordingly, a separate unit for mixing air and gas is not needed. Gas is supplied from nozzles closely installed in front of the Venturi tubes 60.

That is, the Venturi tubes 60 and the mixture supply tubes 40 are installed in the inlet holes 90 in which gas sprayed and supplied from the nozzles, and air supplied from the air blower 50, are mixed. The mixture flow is distributed to the fire hole units 21 and 31 of each burner.

As shown in FIG. 4, when the plate-shaped burner 30 is mounted in the tube-shaped burner 20, a water tube 70 through which water circulates to cool the burner is provided, so that deformation such as buckling is prevented from occurring.

That is, the plate-shaped burner 30 is simply fitted into the loader 22 of the tube-shaped burner 20. In this case, the water tube 70 penetrates the insertion hole 12 formed in the lateral surface of the main casing 10 and fitted into a fitting hole 23 formed in the lateral surface of the tube-shaped burner 20 and a fitting hole 33 formed in the pin structure 32 formed on the bottom surface of the plate-shaped burner 30 in correspondence to the fitting hole 23 formed in the tube-shaped burner 20. This firmly fixes the tube-shaped burner 20 and the plate-shaped burner 30. As a result, water circulating along the water tube 70 can cool the overheated burner simultaneously.

In other words, since the cooling water tube 70 penetrates the pin structure 32 formed in the lower end of the plate-shaped burner 30, heat generated in the upper fire hole unit 31 is discharged through the pin structure 32 although the burner is overheated. In this case, water is supplied through the cooling water tube 70 to cool the burner. As a result, the premixed combustion gas burner according to the present invention has a merit that deformation such an buckling due to thermal tension caused by overrunning the burner is prevented.

Also, if the temperature of flames is lowered through a cooling function of the cooling water circulating through the water tube 70, a greater amount of nitrogen oxide generated can be reduced and damage by a fire due to heat cumulated on the burner surface can be prevented.

In addition, the cooling water tube 70 plays a role of fixing the tube-shaped burner 20 and the plate-shaped burner 30 when the plate-shaped burner 30 is mounted in the loaders 22 of the tube-shaped burner 20.

Reference numeral 80 shown in FIG. 5 denotes a tension bolt 80. The tension bolt 80 penetrates the front faces of the mixture supply tubes 40 from the rear surface of the main casing 10. This firmly fixes the main casing 10 and the mixture supply tubes 40. A reference numeral 41 denotes an inhaled air outlet 41 which is provided in the lower end of the front surface of the mixture supply tubes 40. The inhaled air outlet 41 discharges air inhaled through the air blower 50.

As described above, the premixed combustion gas burner according to the present invention allows the tube-shaped burner 20 and the plate-shaped burner 30 to be separated from each other. Thus, has a structure of a typical premixed combustion gas burner and thus has a merit of the typical premixed combustion gas burner.

That is, the length of the flames in whole is reduced and the temperature of the flames is lowered as well. Thus, a load for an identical area is reduced to thereby reduce generation of pollution materials such as mono-oxide and nitrogen oxide.

Also, the premixed combustion gas burner according to the present invention having a structure whereby the tube-shaped burner 20 and the plate-shaped burner 30 can be separated from each other presents the added characteristic that the present invention can be easily fabricated into a burner assembly having a relatively smaller size and a higher load in comparison with the conventional Bunsen burner and premixed combustion gas burner. Thus, the present invention can easily change a design of the premixed combustion gas burner by varying the number of burners according to a target heat capacity of a full load in the burner.

Referring to FIG. 5, three premixed combustion gas burners are disposed in parallel with one another as an embodiment of the present invention. However, the present invention is not limited in the above-described embodiment. Although a number of premixed combustion gas burners are disposed in parallel with one another, the number of operating burners can be varied according to a desired calorie.

In particular, the output of the burner in the present invention is influenced by the number of the plates where the fire hole units are disposed. Thus, the burner capacity is easily changed according to the number of plates and the size of the fire holes.

Additionally, since the fire hole units are separated into several pieces in the present invention, a twisted degree due to thermal expansion is minimized although the burner surface is cumulatively heated. Thus, maintenance of the running performance of the burner is more consistent in comparison with the conventional premixed combustion gas burners.

As described above, according to the present invention, even in the case that a total number of fire hole units formed on the surface of the burner are separated into several pieces, a twisted degree due to thermal expansion is minimized although the burner surface is cumulatively heated. This prevents deformation due to thermal expansion, and allows for easily changing the size and number of the fire hole units to easily change the total capacity of the burner. Therefore, the present invention provides a very useful and efficient invention having the benefit of improved maintenance of the running performance of the burner in comparison with the conventional premixed combustion gas burners.

Also, in a premixed combustion gas burner having a tube-shaped burner and a plate-shaped burner which are separated from each other, according to the present invention, a cooling water tube penetrates a pin structure formed on the lower end of the plate-shaped burner, in order to cool an overheated burner through water circulating through the cooling water tube. This prevents deformation of the burner, such as buckling, caused by thermal tension existing in the burner which may be caused by an excessive running of the burner.

Also, the temperature of the flames is lowered through the cooling function as described above. This reduces the amount of nitrogen oxide produced and to prevents damage by a fire due to cumulative heat on the burner surface.

Also, the present invention is a very useful and efficient invention playing a role of making the water tube fixing the tube-shaped burner and the plate-shaped burner.

It is apparent to one who is skilled in the art that there are many variations and modifications without departing off the spirit of the present invention and the scope of the appended claims.

What is claimed is:

1. A premixed combustion gas burner having separated fire hole units comprising:

a tube-shaped burner having an opened front face and a hollow tubular shaped inner portion wherein the whole fire hole units of the burner can be separated to prevent deformation due to thermal expansion, the fire hole units, each having a number of fire holes formed at a predetermined distance from one another, disposed in both edge lines and an inner portion on an upper end face, and loaders, each having a predetermined space, formed between the fire hole units; and a plate-shaped burner made of a plate-shaped material having a pin structure formed on a bottom thereof so as to be mounted on the loaders formed in the tube-shaped burner, the fire hole units, having a number of fire holes formed at a predetermined distance, are disposed in the form of a slit along both the edge lines of the upper end face.

2. The premixed combustion gas burner of claim 1, wherein the number of fire holes forming the fire hole units of the tube-shaped burner and the plate-shaped burner are formed with a uniform size by a press.

3. The premixed combustion gas burner of claim 1, wherein a cooling water tube is disposed to penetrate the fire holes through fitting holes formed on a lateral surface of the tube-shaped burner and fitting holes formed on the pin-structure formed on the bottom of the plate-shaped burner, in correspondence to the fitting holes of the tube-shaped burner.

* * * * *